US008485570B2

(12) United States Patent
Konchan

(10) Patent No.: US 8,485,570 B2
(45) Date of Patent: Jul. 16, 2013

(54) DOOR LOCK ASSEMBLY WITH INERTIA LOCK

(75) Inventor: Jeffrey L. Konchan, Romeo, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 193 days.

(21) Appl. No.: 12/748,674

(22) Filed: Mar. 29, 2010

(65) Prior Publication Data

US 2011/0233944 A1 Sep. 29, 2011

(51) Int. Cl.

| | |
|---|---|
| ***E05C 3/02*** | (2006.01) |
| ***E05C 3/06*** | (2006.01) |
| ***E05C 3/04*** | (2006.01) |

(52) U.S. Cl.

USPC ..... 292/194; 292/196; 292/200; 292/202; 292/DIG. 22; 292/DIG. 23

(58) Field of Classification Search

CPC . E05C 3/042; E05B 53/00; E05B 81/06; E05B 65/006; E05B 77/06

USPC ..... 292/194, 196, 200, 202, DIG. 22, 292/DIG. 23, 1

See application file for complete search history.

(56) References Cited

U.S. PATENT DOCUMENTS

| | | | | | |
|---|---|---|---|---|---|
| 2,826,444 | A * | 3/1958 | Kurilenko | 292/177 |
| 2,864,641 | A * | 12/1958 | Leslie | 292/336.3 |
| 3,104,124 | A * | 9/1963 | Beck | 292/280 |
| 3,583,741 | A * | 6/1971 | Breitschwerdt et al. | 292/216 |
| 3,799,596 | A * | 3/1974 | Nozomu et al. | 292/216 |
| 3,990,531 | A * | 11/1976 | Register | 180/281 |
| 4,290,634 | A * | 9/1981 | Gelhard | 292/201 |
| 4,536,021 | A * | 8/1985 | Mochida | 292/201 |
| 5,769,471 | A * | 6/1998 | Suzuki et al. | 292/336.3 |
| 6,471,259 | B1 * | 10/2002 | Weyerstall et al. | 292/201 |
| 6,474,705 | B1 * | 11/2002 | Mori et al. | 292/216 |

* cited by examiner

*Primary Examiner* — Kristina R. Fulton
*Assistant Examiner* — Nathan Cumar

(57) ABSTRACT

A door lock assembly for a vehicle door comprises a door inner panel, including a stop, and a bell crank assembly. The bell crank assembly includes a bell crank main plate mounted adjacent to the door inner panel and pivotable about a bell crank pivot axis, a door lock rod extending generally vertically from the main plate and including an end accessible by a vehicle occupant, a latch rod extending horizontally from the main plate and including an end engaging a latch for locking and unlocking the latch, and an inertial pendulum having a first end affixed to the main plate and an opposed free end cantilevered from the main plate, with the inertial pendulum configured so that inertia on the inertial pendulum causes the free end to engage the stop to prevent rotation of the main plate during a vehicle impact event.

11 Claims, 1 Drawing Sheet

DOOR LOCK ASSEMBLY WITH INERTIA LOCK

BACKGROUND OF INVENTION

The present invention relates generally to door locks used on vehicle doors.

Some vehicle doors, especially doors on automotive vehicles that have manual door locks, employ latch rods that extend between a bell crank assembly and a door latch. For rear doors in particular on automotive vehicles, the latch rod may be long enough that it has significant mass. The mass of this rod may be enough that, during certain types of vehicle impacts, the inertia from the mass is enough to cause a self-locking of the door. This self-locking due to the inertia during impact may be undesirable and possibly against vehicle regulations in certain countries.

Thus, to avoid this concern, some have added large and heavy counterbalance arms with counterweights to counteract the inertia of the latch rod and minimize the chances of self-locking during certain vehicle impact events. However, this adds to the weight of the door and may create concerns with packaging of components in the door.

SUMMARY OF INVENTION

An embodiment contemplates a door lock assembly for a vehicle door comprising a door inner panel, including a stop, and a bell crank assembly. The bell crank assembly includes a bell crank main plate mounted adjacent to the door inner panel and pivotable about a bell crank pivot axis, a door lock rod extending generally vertically from the bell crank main plate and including a remote end configured to be accessible by a vehicle occupant, a latch rod extending generally horizontally from the bell crank main plate and including a remote end configured to engage a latch for locking and unlocking the latch, and an inertial pendulum having a first end affixed to the bell crank main plate and an opposed second, free end cantilevered from the bell crank main plate, with the inertial pendulum configured so that inertia on the inertial pendulum causes the second, free end to engage the stop to prevent rotation of the bell crank main plate in a predetermined direction during a predetermined vehicle impact event.

An advantage of an embodiment is that a simple, low cost and low weight inertia lock is provided that minimizes concerns with self-locking during certain vehicle impact events. This is particularly advantageous for vehicle rear doors that have manual door locks with long latch rods. In addition, with no need for additional parts, there are no added assembly operations with this added feature, again minimizing costs. Also, an increase in packaging space for the bell crank assembly is not required.

DETAILED DESCRIPTION

Figure 1:
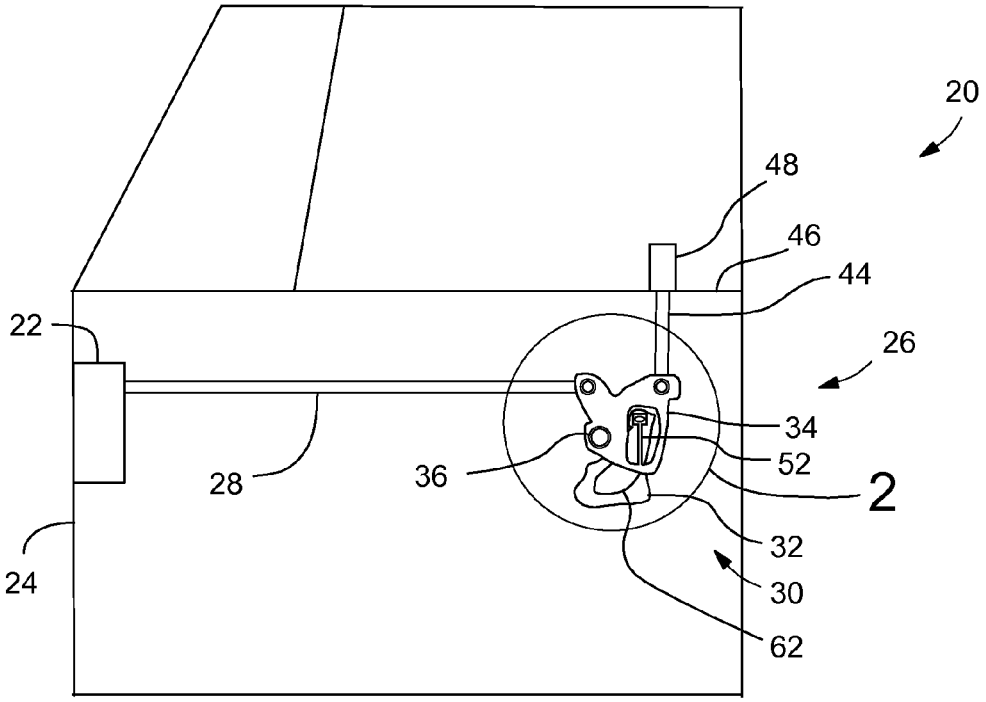
FIG. 1 is a schematic, perspective view of a portion of a vehicle door.
Figure 2:
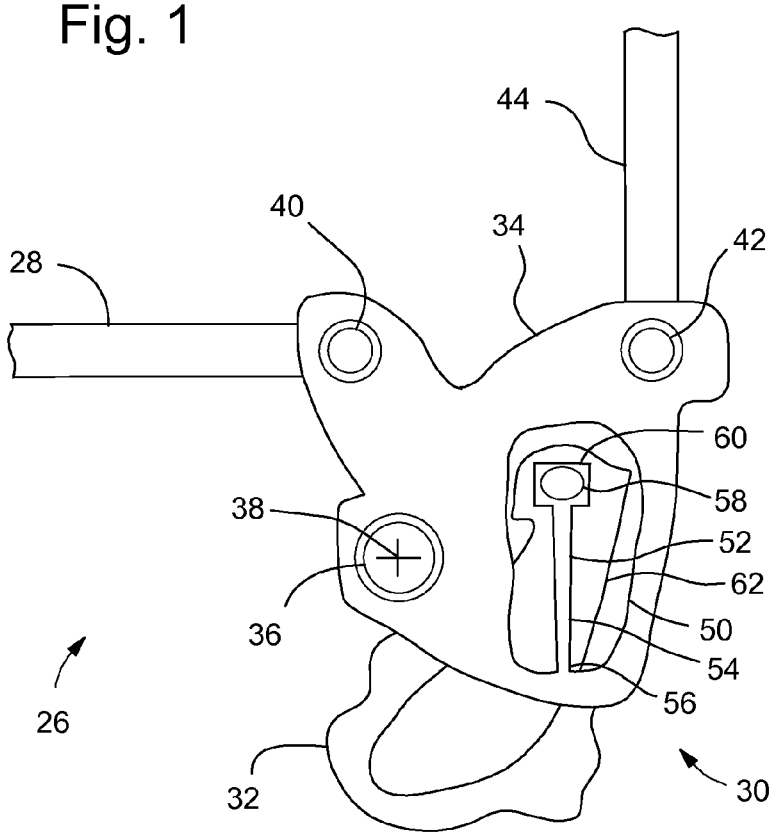
FIG. 2 is a schematic view, on an enlarged scale, of encircled area 2 in FIG. 1.

Referring to FIGS. 1 and 2, a portion of a vehicle door, indicated generally at 20, is shown. The vehicle door 20 includes a lock assembly 26 having a latch 22, which may be conventional, at a rear end 24 of the door 20. A latch rod 28 engages the latch 22 and extends forward in the door 20 to a bell crank assembly 30, which is adjacent to a door inner panel 32 (a small portion of which is shown).

The bell crank assembly 30 includes a bell crank main plate 34 having a bell crank pivot pin 36 extending therethrough that is mounted to the door 20 and defines a bell crank pivot axis 38 about which the bell crank main plate 34 is pivotable. The bell crank main plate 34 is mounted adjacent to the door inner panel 32. The bell crank main plate 34 is also secured to a latch rod pivot pin 40, which is attached to a forward end of the latch rod 28, and a lock rod pivot pin 42, which is attached to a lower end of a door lock rod 44. The door lock rod 44 extends upward and through a door sill 46, with the upper end of the door lock rod 44 having a door sill button 48 mounted on top and accessible by vehicle passengers.

A cutout area 50 in the main plate 34 includes an inertia pendulum 52 mounted therein. The inertia pendulum 52 has a pendulum lock bar 54 that attaches at a first end 56 to the main plate 34 and extends outward in a cantilever fashion. The pendulum lock bar 54 may have a weight 58 mounted at its second, free end 60. The pendulum lock bar 54 will act, in effect, like a leaf spring.

The pendulum lock bar 54 may be integral with the main plate 34—that is, the main plate 34 and pendulum lock bar 54 may be formed as a single monolithic piece. For example, the bell crank main plate 34 and pendulum lock bar 54 may be formed as a single injection molded plastic part. The weight may be, for example, a die cast zinc that is molded into the pendulum lock bar 54 when formed or pressed into it after forming. Although, other materials and forming methods may used instead, if so desired.

The door inner panel 32 includes a slot 62 (or other type of feature acting as a stop) adjacent to the inertial pendulum 52. This slot 62 is located so that the second end 60 of the pendulum lock bar 54 can pivot into contact with the slot 62 during certain vehicle impact events. The pendulum lock bar 54 may extend out of plane of the bell crank main plate 34 so that the second end 60 is in the plane of the slot 62 of the door inner panel 32.

The operation of the lock assembly will now be discussed. Under routine conditions, the lock assembly 26 operates as a conventional type of door lock for the vehicle door 20. That is, when one pulls up on the door sill button 48, the door lock rod 44 will be pulled upward, which pulls upward at the lock rod pivot pin 42. This upward motion causes the bell crank main plate 34 to pivot counterclockwise (as seen in the figures) about the bell crank pivot axis 38, which, in turn, pushes the latch rod pivot pin 40 rearward. This rearward movement causes the latch rod 28 to translate rearward, with the rear end of the latch rod 28 engaging the latch 22 to cause the latch 22 to unlock.

Under certain vehicle impact conditions, the tendency may be for the latch rod 28, due to its inertia, to exert a forward directed force relative to the latch 22, which, in a conventional arrangement, may engage the latch 22 to cause the latch 22 to unlock. However, with the present invention, under this same type of vehicle impact condition, the inertia of the inertial pendulum 52 will cause the second end 60 and weight 58 of the pendulum lock bar 54 to pivot into contact with the slot 62 in the door inner panel 32, (with the lock bar 54 acting like a leaf spring). Thus, at the same instant that the inertia of the latch rod 28 may exert a force attempting to rotate the bell crank main plate 34 in a clockwise direction (as viewed in the figures), the inertia on the inertial pendulum 52 will cause the engagement of the second end 60 of the pendulum lock bar 54 with the slot 62, thus locking the main plate 34 to prevent such a counterclockwise rotation of the main plate 34. Consequently, at that instant of the impact event, the latch rod 28 cannot move to cause the latch 22 to lock.

After the impact is over, the inertia loads on the latch rod 28 and inertia pendulum 52 dissipate. The pendulum lock bar 54, then, pivots back into its initial, rest position out of contact with the slot 62 in the door inner panel 33, thus allowing the lock assembly to again operate in a conventional fashion.

While certain embodiments of the present invention have been described in detail, those familiar with the art to which this invention relates will recognize various alternative designs and embodiments for practicing the invention as defined by the following claims.

What is claimed is:

1. A door lock assembly for a vehicle door comprising:

a door inner panel including a stop; and a bell crank assembly including a bell crank main plate mounted adjacent to the door inner panel and configured to be pivotable about a bell crank pivot axis, a door lock rod extending generally vertically from the bell crank main plate and including a remote end configured to be accessible by a vehicle occupant, a latch rod extending generally horizontally from the bell crank main plate and including a remote end configured to engage a latch for locking and unlocking the latch, and an inertial pendulum having a first end affixed to the bell crank main plate and an opposed second, free end cantilevered from the bell crank main plate, the first end being spaced from the bell crank pivot axis, and the inertial pendulum configured so that inertia on the inertial pendulum causes the second, free end to engage the stop to prevent rotation of the bell crank main plate in a predetermined direction during a predetermined vehicle impact event.

2. The door lock assembly of claim 1 wherein the bell crank assembly includes a weight mounted to the inertial pendulum adjacent to the second, free end.

3. The door lock assembly of claim 1 wherein the bell crank main plate and the inertial pendulum are a single, monolithic piece.

4. The door lock assembly of claim 1 wherein the bell crank main plate and the inertial pendulum are molded plastic that is molded into a single, monolithic piece.

5. The door lock assembly of claim 1 wherein the stop is an edge of a slot in the door inner panel.

6. The door lock assembly of claim 1 wherein the door lock rod is attached to the bell crank main plate at a first end by a first pivot pin and the latch rod is attached to the bell crank main plate at a first end by a second pivot pin.

7. A door for a vehicle comprising:

a door inner panel having a stop;

a door sill;

a latch that is lockable to prevent the vehicle door from opening; and a bell crank assembly including a bell crank main plate mounted adjacent to the door inner panel and configured to be pivotable about a bell crank pivot axis, a door lock rod extending generally vertically from the bell crank main plate and including a remote end extending through the door sill and configured to be accessible by a vehicle occupant, a latch rod extending generally horizontally from the bell crank main plate and including a remote end engaging the latch for locking and unlocking the latch, and an inertial pendulum having a first end non-rotatably fixed directly to the bell crank main plate and an opposed second, free end cantilevered from the bell crank main plate, the first end being spaced from the bell crank pivot axis, and the inertial pendulum configured so that inertia on the inertial pendulum causes the second, free end to engage the stop to prevent rotation of the bell crank main plate in a predetermined direction during a predetermined vehicle impact event.

8. The door of claim 7 wherein the door is a side vehicle door, the latch is at a rear end of the door and the latch rod extends in a fore-aft direction of the vehicle.

9. The door of claim 8 wherein the bell crank main plate is located adjacent to a front end of the door and the predetermined vehicle impact event is an impact of a front of the vehicle with an object.

10. The door of claim 7 wherein the bell crank assembly includes a weight mounted to the inertial pendulum adjacent to the second, free end.

11. The door of claim 7 wherein the stop is an edge of a slot in the door inner panel.

* * * * *